US007784246B2

(12) United States Patent
Mori

(10) Patent No.: US 7,784,246 B2
(45) Date of Patent: Aug. 31, 2010

(54) SHEET PROCESSING APPARATUS AND ELECTROMAGNETIC LOCKING METHOD OF STACKING DEVICE

(75) Inventor: Takao Mori, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/435,172

(22) Filed: May 4, 2009

(65) Prior Publication Data

US 2009/0293424 A1 Dec. 3, 2009

Related U.S. Application Data

(63) Continuation of application No. PCT/JP2007/001191, filed on Oct. 31, 2007.

(30) Foreign Application Priority Data

Nov. 2, 2006 (JP) ..... 2006-299544

(51) Int. Cl.
*B65B 11/00* (2006.01)
*G07D 9/00* (2006.01)

(52) U.S. Cl. ..... 53/399; 53/447; 53/540; 53/582; 209/534; 292/251.5

(58) Field of Classification Search ..... 53/399, 53/582, 447, 540, 498–500; 194/350; 209/534; 235/379; 292/251.5; 382/135
See application file for complete search history.

(56) References Cited

U.S. PATENT DOCUMENTS 4,376,364 A * 3/1983 Horino et al. ..... 53/500
4,772,781 A * 9/1988 Watanabe ..... 235/379
5,012,932 A * 5/1991 Omura et al. ..... 53/500
5,105,364 A * 4/1992 Kawamura et al. ..... 902/13
5,335,484 A * 8/1994 Hain ..... 53/582
5,555,983 A * 9/1996 Yamagishi ..... 209/534
6,000,555 A * 12/1999 Anma ..... 209/534

(Continued)

FOREIGN PATENT DOCUMENTS

JP 58086666 A * 5/1983

(Continued)

*Primary Examiner*—Stephen F Gerrity
(74) *Attorney, Agent, or Firm*—Pillsbury Winthrop Shaw Pittman, LLP

(57) ABSTRACT

To provide a sheet processing apparatus and an electromagnetic locking method of a stacking device for unlocking a stacking device cover when a door of the sheet processing apparatus is closed, shortening the power supply time of an electromagnetic lock, suppressing power consumption, and displaying permission of access to the stacking device. When a condition of unlocking a stacking portion and opening of the door is detected, the electromagnetic lock is held in an unlocking state and a cover opening-closing permission display lamp is turned on. After end of an operation by an operator, if the closing of the door is detected by a door detection device, the electromagnetic lock of the stacking device is turned off and the lamp is turned off. As a result, an unlocking condition is held when no power is supplied to a solenoid. Further, when a condition of locking the stacking portion occurs, if the opening of the door is detected, the electromagnetic lock is turned on, and the lamp is turned off, and after the operation ends, if the closing of the door is detected, the electromagnetic lock is turned off and the lamp is turned off.

7 Claims, 10 Drawing Sheets

U.S. PATENT DOCUMENTS

| | | | | |
|---|---|---|---|---|
| 6,502,052 | B1 * | 12/2002 | Someya et al. | 235/379 |
| 2002/0053594 | A1 * | 5/2002 | Haney et al. | 235/381 |
| 2002/0153290 | A1 * | 10/2002 | Otsuka | 209/534 |
| 2004/0134839 | A1 * | 7/2004 | Kobayashi et al. | 209/534 |

FOREIGN PATENT DOCUMENTS

| | | | | |
|---|---|---|---|---|
| JP | 59-113855 | A | | 8/1984 |
| JP | 59113855 | U | * | 8/1984 |
| JP | 60093580 | A | * | 5/1985 |
| JP | 62-39481 | | | 10/1987 |
| JP | 02-287689 | | | 11/1990 |
| JP | 03-034093 | | | 2/1991 |
| JP | 04-371444 | | | 12/1992 |
| JP | 2000235677 | A | * | 8/2000 |

* cited by examiner

SHEET PROCESSING APPARATUS AND ELECTROMAGNETIC LOCKING METHOD OF STACKING DEVICE

CROSS-REFERENCE TO RELATED APPLICATION

This application is based upon and claims the benefit of priority from the prior Japanese Patent Application No. 2006-299544, filed on Nov. 2, 2006, and International Application No. PCT/JP2007/001191, filed on Oct. 31, 2007; the entire contents of all of which are incorporated herein by references.

FIELD OF THE INVENTION

The present invention relates to a sheet processing apparatus for processing sheets such as marketable securities and more particularly to an electromagnetic locking method of a stacking device loaded on the concerned apparatus.

DESCRIPTION OF THE BACKGROUND

The sheet processing apparatus for processing sheets such as marketable securities is an apparatus for taking out and conveying sheets one by one by a take-out device from sheet bundles inserted in a batch according to the processing unit, checking for the quality (shape, damage, blurred print, stains, etc.) of the concerned sheets by the sheet check device, sorting the sheets into normal bills (hereinafter, referred to as quality bills), abnormal bills (hereinafter, referred to as disqualified bills), and rejected bills such as abnormal conveying bills and double feed bills and temporarily stacking them in a stacking device, and sealing them, when the number of sheets stacked temporarily reaches a predetermined number of sheets, by paper straps. For example, quality bills are sealed by a paper strap as a binding strap for each 100 sheets so as to form a bunch and 10 bunches are stacked up whenever necessary and are sealed additionally by a paper strap so as to form a bundle.

In the sheet processing apparatus, since counted sheets are stacked on the stacking device, from the viewpoint of security, the stacking device is locked (turned on) by an electromagnetic lock. Conventionally, the locking by the electromagnetic lock is performed regardless of the door condition of the sheet processing apparatus (for example, refer to Patent Document 1).

Patent Document 1: Japanese Utility Model Examined Publication No. 62-39481 (FIG. 4 on page 2)

However, in the sheet processing apparatus stated in Patent Document 1, the locking by the electromagnetic lock is performed regardless of the door condition of the sheet processing apparatus, so that (1) the power supply time under the electromagnetic lock is prolonged and the life span of the electromagnetic lock is shortened. (2) The power consumption of the apparatus is large. (3) It is not found that the stacking device is under the electromagnetic lock, so that when an operator should perform the process of the stacking portion, he does not perform it but may perform a malfunction such as the initialization. (4) Further, as a result of the malfunction, the process of the apparatus goes to the next process, and the sheet processing apparatus may not be operated normally, thus a problem arises that a failure such as a new device stop is caused.

The present invention was developed to solve the aforementioned problem and provides a sheet processing apparatus and an electromagnetic locking method of a stacking device loaded on the concerned apparatus for controlling so as to shorten the power supply time of the electromagnetic lock by detecting the door condition of the sheet processing apparatus, thereby lengthening the life span of the electromagnetic lock, suppressing the power consumption of the sheet processing apparatus, and preventing the malfunction by making it possible to find that the stacking device is under the electromagnetic lock.

SUMMARY OF THE INVENTION

To accomplish the above object, there is provided A sheet processing apparatus to sort a plurality of processing units to process sheets into a plurality of units and store them in a main body, wherein: the plurality of units include: a door to be opened and closed when accessing the processing unit arranged in the plurality of units; and a door opening-closing detection device to detect opening and closing of the door, and the plurality of processing units include: an operation display device having an input device to input by an operator and an display device to notify to the operator; a conveying path to convey the sheets; a sheet check device to discriminate the sheets conveyed by the conveying path; a stacking device having a stacking storage to stack the sheets on the basis of the discrimination results of the sheet check device and a stacking storage cover to access internally the stacking storage; a sealing device to seal the sheets stacked on the stacking device; an electromagnetic locking device to lock or unlock the stacking storage cover; a cover opening-closing permission display to display permission of opening and closing of the stacking storage cover; and a controller, when a condition of locking or unlocking the stacking device occurs, to control the electromagnetic locking device to lock or unlock the stacking storage cover on the basis of the detection results by the door opening-closing detection device.

Further, there is provided an electromagnetic locking method of a stacking device in a sheet processing apparatus to sort a plurality of processing units to process sheets into a plurality of units and store them in a main body including a door to be opened and closed when accessing the processing units arranged in the units, a door opening-closing detection device to detect opening and closing of the door, an operation display having an input device to input by an operator and an display to notifying to the operator, an conveying path to convey the sheets, a sheet check device to discriminate the sheets conveyed by the conveying path, a stacking device having a stacking storage to stack the sheets on the basis of the discrimination results of the sheet check device and a stacking storage cover to access internally the stacking storage, a sealing device to seal the sheets stacked on the stacking device, an electromagnetic locking device to lock or unlock the stacking storage cover, a cover opening-closing permission display to display permission of opening and closing of the stacking store cover, and a controller, when a condition of locking or unlocking the stacking device occurs, to control the electromagnetic locking device to lock or unlock the stacking storage cover on the basis of the detection results by the door opening-closing detection device, comprising: a first step, when a condition of unlocking the stacking storage cover occurs during the processing of the sheets of closing the door, turning off the electromagnetic lock, and opening the stacking storage cover, of detecting opening of the door by the door opening-closing detection device; a second step, when the opening of the door is detected at the first step, of turning off the electromagnetic lock to unlock and hold the stacking storage cover; a third step of displaying the stacking storage cover opening-closing permission display; a fourth step of detecting closing of the door by the door opening-closing detection device after the process by the operator is finished on the basis of the display results at the thirst step; a fifth step, when the closing of the door is detected at the fourth step, of turning off the electromagnetic lock; and a sixth step of turning off the stacking storage cover opening-closing permission display.

DESCRIPTION OF THE PREFERRED EMBODIMENTS

Hereinafter, the embodiments of the present invention will be explained with reference to the accompanying drawings.

Embodiment 1

Figure 1:
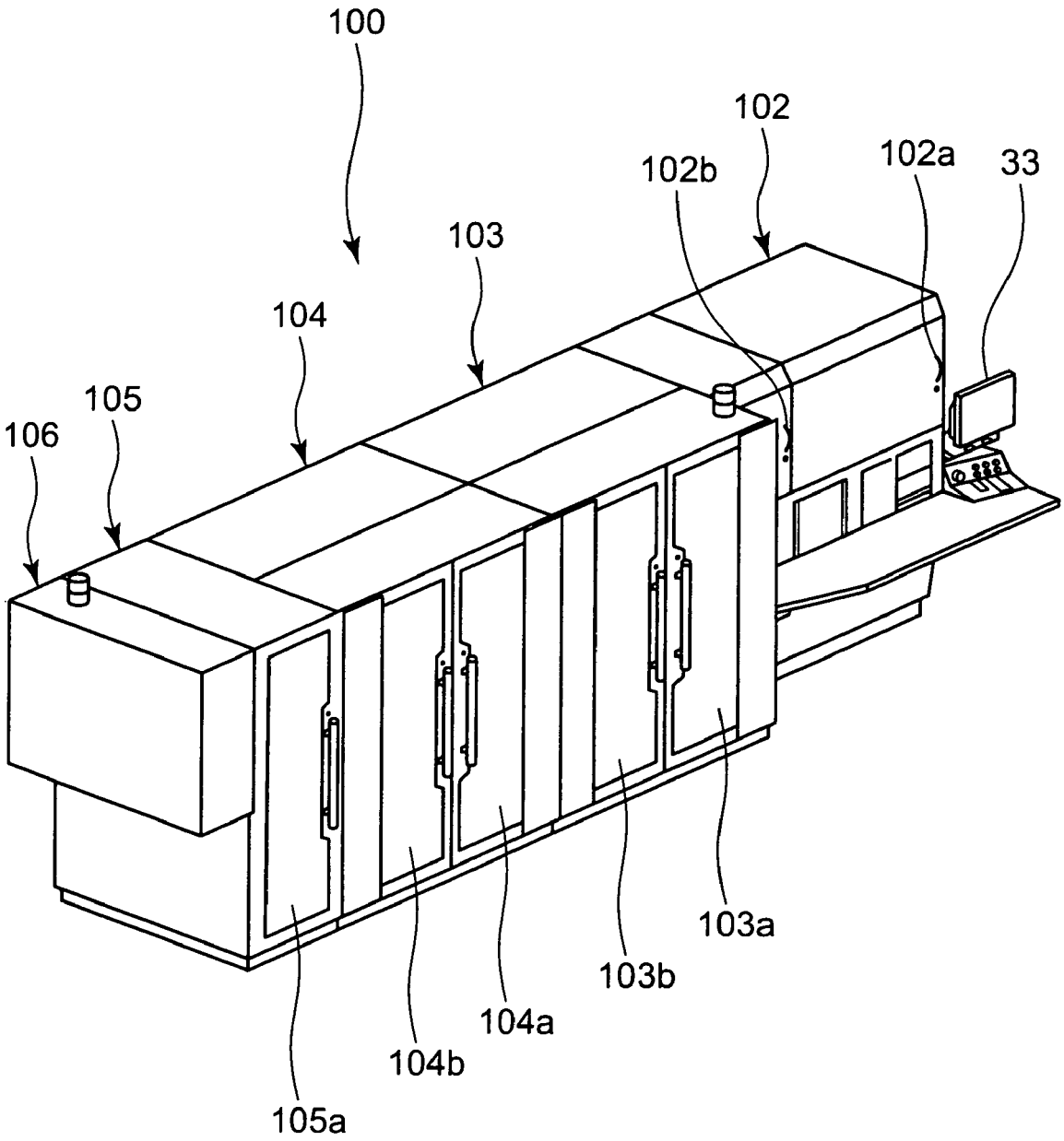
FIG. 1 is an external view of a sheet processing apparatus 100 using the electromagnetic locking method of Embodiment 1 of the present invention.
Figure 2:
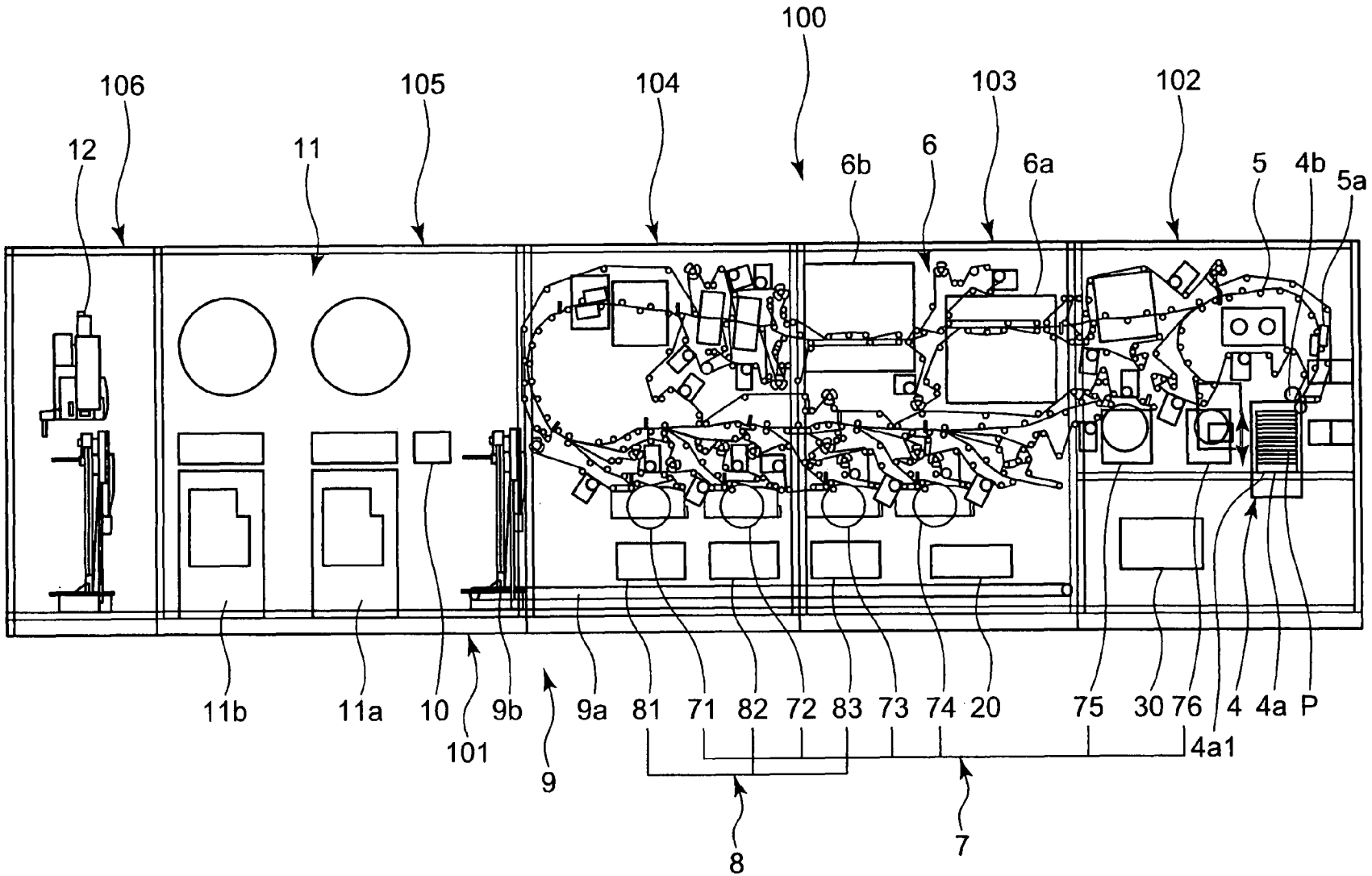
FIG. 2 is a schematic view showing the main parts of the sheet processing apparatus 100 shown in FIG. 1.
Figure 3:
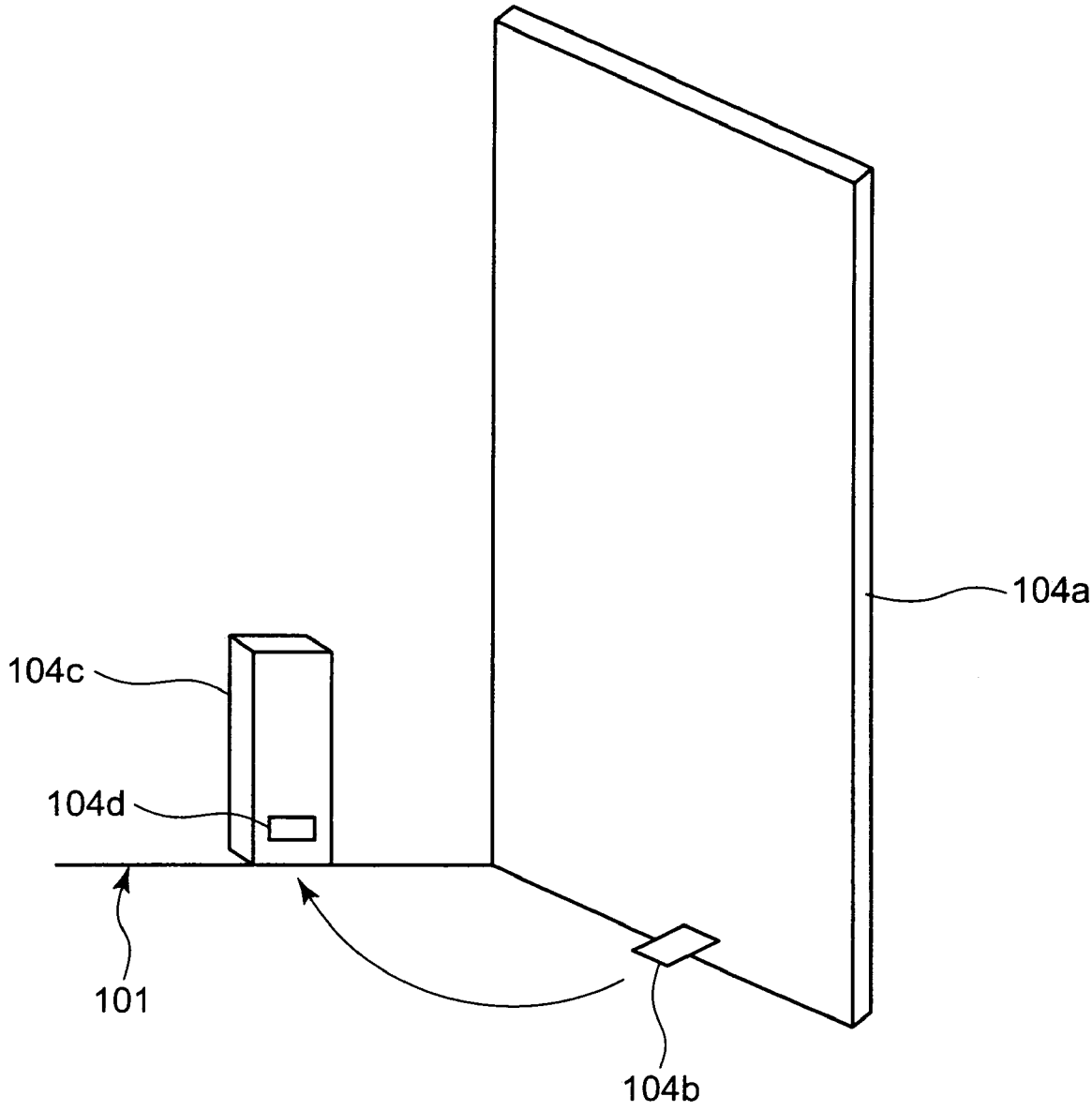
FIG. 3 is a drawing showing the door detection apparatus for detecting opening and closing the door of the sheet processing apparatus 100 shown in FIG. 1.

FIG. 1 is an external view of the sheet processing apparatus 100 using the electromagnetic locking method of Embodiment 1 of the present invention. FIG. 2 is a schematic view showing the main parts of the sheet processing apparatus 100 shown in FIG. 1. FIG. 3 is a drawing showing the opening-closing sensor for detecting opening and closing the door of the sheet processing apparatus 100 shown in FIG. 1.

The sheet processing apparatus 100 shown in FIG. 1 is composed of, from the upstream side to the downstream side in the conveying direction, a first unit 102, a second unit 103, a third unit 104, a fourth unit 105, and sixth unit 106 as an optional unit.

The first unit 102, which is a preprocessing portion for supplying sheets P to a take-out device 4, includes a keyboard for inputting by an operator, an operation display device 33 having a display device such as input device such as a mouse or a touch panel and a display such as a CRT or a liquid crystal display for notifying to the operator, the take-out device 4, a conveyance detection apparatus 5*a*, and rejected bill stacking devices 75 and 76 and is equipped with doors 102*a* and 102*b* so as to access these devices.

The second unit 103 includes a sheet check device 6, stacking devices 73 and 74, and a 100-sheets sealing device 83 and is equipped with doors 103*a* and 103*b* so as to access these devices.

The third unit 104 includes the sheet check device for checking for the thickness and breaking of sheets, stacking devices 71 and 72, and 100-sheets sealing devices 81 and 82 and is equipped with doors 104*a* and 104*b* so as to access these devices.

The fourth unit 105 includes a bundle moving device 9, a print reading device 10, and a 100-sheets sealing device 11 and is equipped with a door 105*a* so as to access these devices.

The fifth unit 106 includes a label issuing-attaching device 12 and is equipped with the door 105*a* so as to access the unit. Further, the fifth unit is an optional unit.

Hereinafter, the constitution and function of the apparatus composing the aforementioned units will be explained roughly. The take-out device 4 includes a supply portion 4*a* for supplying sheet bundles in a batch and a take-out portion 4*b* for taking out the sheets P supplied to the supply portion 4*a* one by one at a fixed interval.

The supply portion 4*a* includes a backup plate 4*a*1 as a supply table for loading a sheet bundle and a take-out position detection device (not shown) for detecting the take-out position of the sheet P on the uppermost surface of the sheet bundle loaded on the backup plate 4*a*1. On the basis of the detection results of the take-out position detection device, so as to move the sheet on the uppermost surface of the sheet bundle to the take-out position, the supply portion 4*a* is equipped with a drive device (not shown) for driving vertically the backup plate 4*a*1.

The take-out portion 4*b* is composed of a take-out roller (not shown) and a drive device therefor (not shown). The take-out roller is structured so as to be internally at a negative pressure and whenever the take-out roller makes one revolution, one sheet P at the uppermost position of stacked sheets is attracted. One sheet is taken out in correspondence with the rotation of the take-out roller, so that the sheets P are sent onto a conveying path 5 continuously at a fixed interval.

The conveying path 5 is composed of a conveying belt, a conveying roller, and a drive motor (not shown). Further, a branching gate for deciding the conveying destination of the sheets P conveyed by the conveying path 5 is controlled by a conveyance controller 20.

The sheets P taken out by the take-out device 4 is detected and discriminated the conveying condition of the sheets by a sensor (the conveying condition detection sensor 5*a*) arranged on the downstream side of the take-out device 4 in the conveying direction. As a result of the discrimination, the sheets P detected for a displacement of conveyance, a skew, or double feed cannot be checked, so that they are stacked on the rejected bill stacking device 76.

The sheet check device 6 includes a sheet check device 6*a* for checking the bottom of the sheets P conveyed and a sheet check device 6*b* for checking the top thereof. The sheet check devices 6*a* and 6*b* are structured similarly to each other and are respectively composed of a sensor for detecting the sheets P conveyed, a light source for lighting the sheets P, and a camera for imaging reflected light from the sheets P and read images obtained from the camera.

The sheet check devices 6*a* and 6*b* check for the quality (shape, damage, blurred print, stains, etc.) of the conveyed sheets P and discriminate them as quality bills, disqualified bills, and rejected bills such as abnormal conveying bills and double feed bills. On the basis of the discrimination results, the aforementioned branching gate is controlled and the sheets P are sorted and conveyed.

The stacking device 7 includes the stacking devices 71 and 72 for stacking quality bills and the stacking devices 73 and 74 for stacking disqualified bills. The stacking devices 7 have a paddle wheel stacking device, stop the sheets P conveyed at a high speed by absorbing the conveying speed of the sheets P, and stack them on a stacking storage (not shown).

The quality bills, on the basis of the discrimination results by the sheet check device 6, are controlled by a conveying-sorting device and are stacked on the stacking devices 71 and 72. The stacking method of the quality bill stacking device will be separately described in detail. The disqualified bills are controlled by the conveying-sorting device similarly to the quality bills and are stacked on the stacking devices 73 and 74. Further, undiscriminatable bills such as different kind bills detected by the sheet check device 6 are similarly controlled by the conveying-sorting device and are stacked on the rejected bill stacking device 75.

Further, when the sheet stacking device 100 processes new bills as shown in this embodiment, the majority of the sheets P is occupied by quality bills, so that as mentioned above, in the quality bill stacking device, three stacking devices 71 to 73 are arranged and in the disqualified bill stacking device, one stacking device 74 may be arranged.

Hereinafter, the situation that quality bills are stacked on the stacking devices 71 and 72 and are sealed by the 100-sheets sealing devices 81 and 82 will be explained. Further, when disqualified bills are stacked on the stacking devices 73 and 74, the same man be said, so that the explanation thereof will be omitted. A conveying-sorting device 13, when the sheets P stacked on the stacking device 71 reach 100 sheets, switches a distribution gate (not shown), prevents the sheets P from being conveyed continuously to the stacking device 71, and stacks the sheets P conveyed continuously on the quality bill stacking device 72. The sheets stacked on the stacking device 71 are transferred to the 100-sheets sealing device 81 arranged on the lower part, and 100 sheets are sealed by a paper strap, thus a bunch H is formed.

When the sheets P stacked on the quality bill stacking device 72 reach 100 sheets, the conveying-sorting device 13 switches the distribution gate (not shown), prevents the sheets P from being conveyed continuously to the quality bill stacking device 72, and stacks the sheets P conveyed continuously on the stacking device 71. The sheets stacked on the quality bill stacking device 72 are transferred to the 100-sheets sealing device 82 arranged on the lower part, and 100 sheets are sealed by a paper strap, thus a bunch H is formed.

The 100-sheets sealing devices 8 are arranged on the lower part of the stacking devices in correspondence to the stacking devices 71 and 72 and the stacking devices 73 and 74 and the sheets stacked on the stacking storages (not shown) of the corresponding stacking devices 71 and 72 by the aforementioned method are bound by a paper strap to form a bunch.

A bundle moving device 9*a* is arranged on the lower part of the 100-sheets sealing devices 81 to 83, and to convey the bunches H formed by the 100-sheet sealing device 8 to the next step, is composed of a conveyor and conveys the bunches H in the stacked state.

A bundle moving device (lifter) 9*b* receives and moves upward the bunches H conveyed by the bundle moving device 9*a* one by one.

The print reading device 10 reads the issue number on the uppermost surface of the bunch H conveyed by the bundle moving device 9*b*. The reading results are transmitted to the conveyance controller 20. When the issue number read by the print reading device 10 is a predetermined value, it is judged that the bunch H sealed by the 100-sheets sealing device 8 is normal.

The bunches H having an issue number of the predetermined value by the print reading device 10 are stacked for each 10 bunches and are transferred to the 1000-sheets sealing device 11. The 1000-sheets sealing device 11 binds the sheets stacked as 10 bunches by a paper strap and forms a bundle S. The 1000-sheets sealing device 11 includes a strap setting portion for setting paper straps, a strap feeder for feeding paper straps, a strap heater for cutting paper straps in a length suited to sealing and adhering them by heat, a winder for winding a paper strap round each 10-bunch sheets, and a pressing portion for pressing the sheets. The aforementioned process can be realized by the prior art, so that detailed explanation will be omitted.

The label issuing-attaching device 12 sticks a label printed with the sheet attributes of the kind of the bundle S, the number of sheets, and the issue location on the top of the bundle S formed by the 1000-sheets sealing device 11.

FIG. 3 is a drawing showing the door detection apparatus for detecting a door 104*a* of the sheet processing apparatus 100 shown in FIG. 2. For example, the stacking devices 71 and 72 shown in FIG. 2 are arranged inside the door 104*a*. On the door 104*a*, a detected article 104*b* rotating together with the door in correspondence with opening and closing of the door is attached. Further, a door detection device 104*c* for detecting the detected article 104*b* is arranged. On the door detection device 104*c*, a detected article output and input port 104*d* for enabling output and input of the detected article 104*b* is arranged, thus opening and closing of the door 104*a* are detected.

In the door opening-closing detection portion structured like this, for example, when the door 104*a* is closed, the detected article 104*b* is inserted into the detected article output and input port 104*d* of the door detection device 104*c* (hereinafter, referred to as a door closed state) and is detected. The door 104*a* of the sheet processing apparatus is ordinarily used in the closed state.

FIG. 3 shows the state that, for example, a difficulty happens inside the apparatus and the door 104*a* is opened to cancel the difficulty (hereinafter, referred to as a door opened state). In this case, the detected article 104*b* is in the state discharged from the detected article output and input port 104*d* of the door detection device 104*c*.

Figure 4:
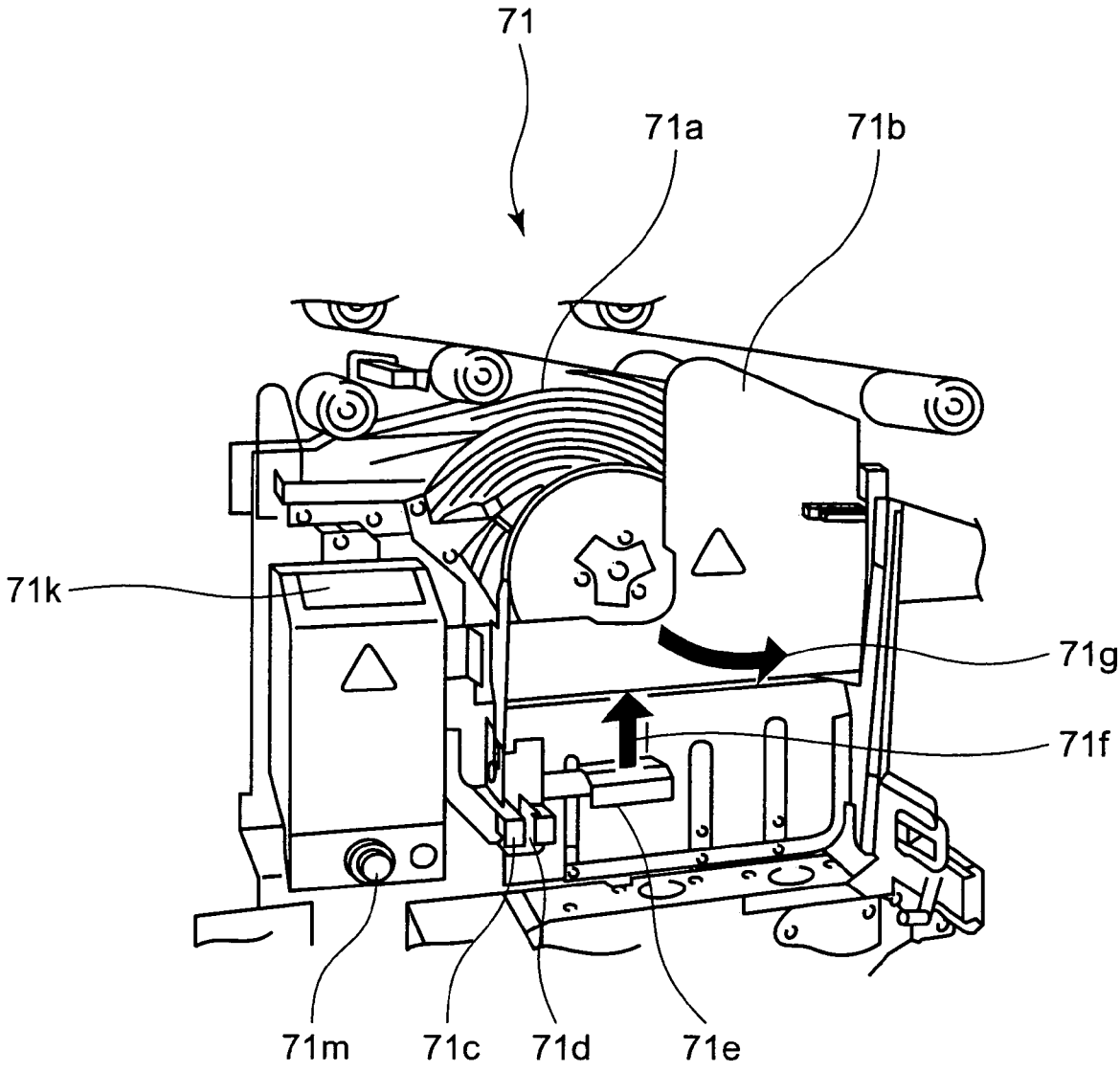
FIG. 4 is an external view of a stacking device 71.

FIG. 4 is an external view of the stacking device 71. On the stacking device 71, a paddle wheel 71*a*, a stacking storage (not shown), a stacking storage cover 71*b*, a lever position sensor 71*c*, and a lever 71*e* are arranged to compose the paddle wheel stacking device. A plurality of paddle wheels 71*a* of the paddle wheel stacking device are arranged around the rotary shaft and the sheets P conveyed can be received between the paddles by rotating in synchronization with the conveyance of the sheets P. By use of such a constitution, the sheets P are stopped in conveyance by absorbing the conveying energy of the sheets P conveyed at a high speed, are scraped by a scrape plate (not shown) by rotation, are discharged from the paddle wheels 71*a*, and are stacked in the stacking storage.

The operation is common to the stacking devices 71 and 72, the stacking devices 73 and 74, and the rejected bill stacking device 75.

The stacking storage of this embodiment is equivalent to the inside portion of the stacking storage cover 71*b* and stacks the sheets P discharged from the paddle wheels 71*a*.

The stacking storage cover 71*b* has a cover function for preventing the sheets P stacked in the stacking storage from jumping out and a security function for prevent the stacked sheets from being externally accessed and taken out easily. Therefore, the stacking storage cover 71*b* is locked so as not to be opened and closed when opening and closing are not permitted. Cancellation of the locking method will be explained separately in detail.

The lever position sensor 71*c* is a sensor for detecting the position of the lever 71*e* and optically detects a light shield plate 71*d* moving in correspondence with the vertical movement of the lever 72*e*. In the state shown in FIG. 4 that the lever 71*e* is positioned on the lower side, the lever position sensor 71*c* is in the state that the light shield plate 71*d* is detected.

Further, as a permission display to permit access to the stacking device 71, a cover opening-closing permission display lamp (a cover opening-closing permission display) 71*m* to permit opening and closing of the stacking storage cover 71*b* is installed and when the cover opening-closing permission display lamp 71*m* is on, the operation of opening and closing the cover of the concerned stacking portion can be performed.

Figure 5:
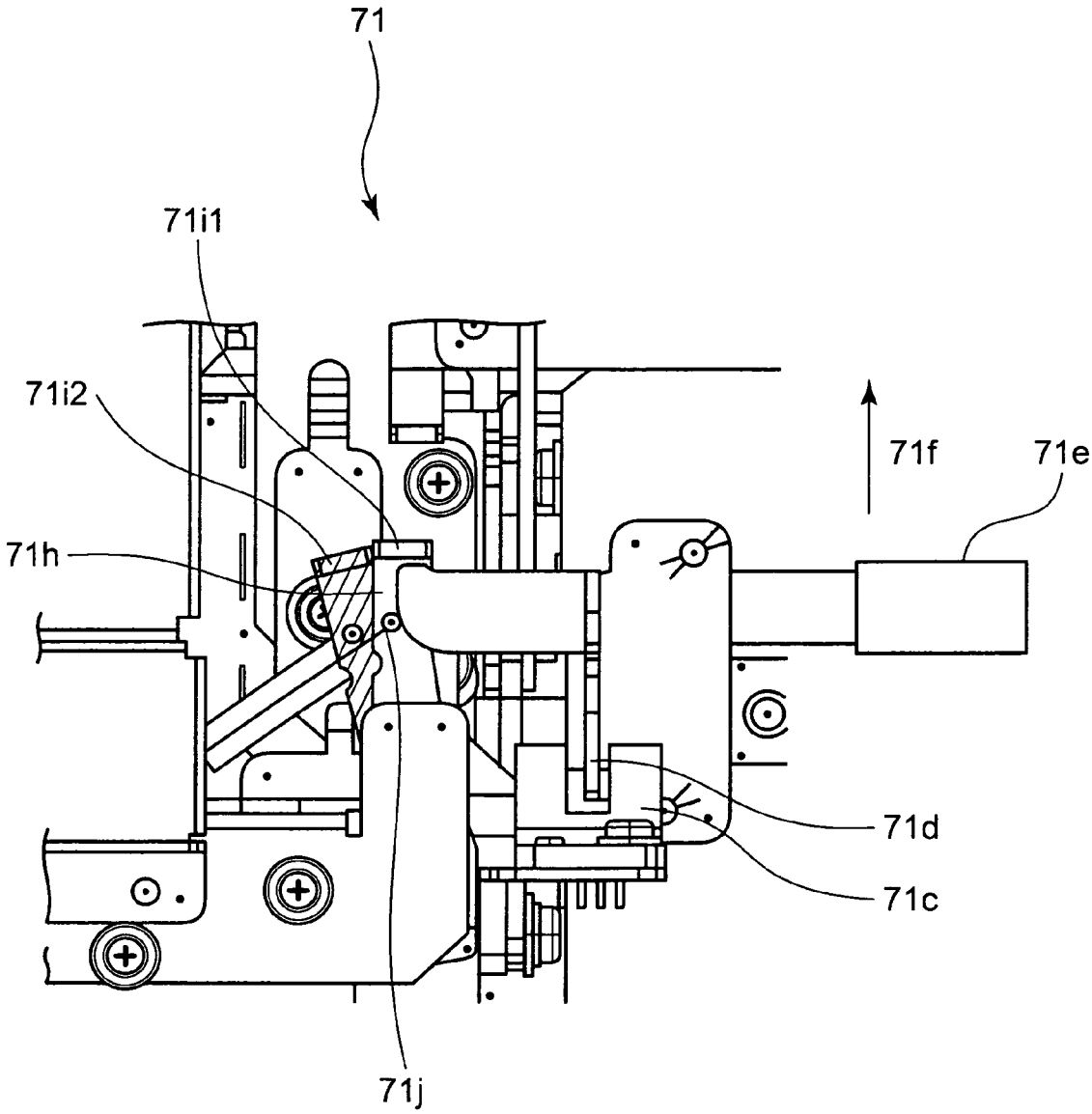
FIG. 5 is a drawing for explaining locking and unlocking when opening and closing the stacking storage cover shown in FIG. 4.

FIG. 5 is a drawing for explaining locking and unlocking when opening and closing the stacking storage cover 71*b* shown in FIG. 4. To open and close the stacking storage cover 71*b*, it is necessary to move up (slide) the lever 71*e* in the direction of an arrow 71*f* shown in the drawing. In this embodiment, to prevent the stacking storage cover 71*b* from being opened and closed when it is not permitted for security of the stacking storage, the lever 71*e* is locked. Hereinafter, the method will be explained.

When the lever 71*e* is in the locked state (the electromagnetic lock on state), to prevent the left end surface of the lever 71*e* from moving up, a stopper 71*h* is attracted by the electromagnetic locking device such as a solenoid and is put into the state at a position 71*i*1. As a result of it, the lever 71*e* cannot move up because the rising course direction is closed (it is put into the locked state; in the locked state, the stacking storage cover 71*b* cannot be opened and closed).

On the other hand, if no power is supplied to the solenoid, the stopper 71*h* is pulled by a spring 71*j* and is put into the state at a position 71*j*2. In this case, the lever 71*e* can move up and if the lever 71*e* moves up, the lever position sensor 71*c* is not shielded light by the light shield plate 71*d*. As a result, the lever 71*e* enters the unlocked state and the stacking storage cover 71*d* can be opened and closed.

Figure 6:
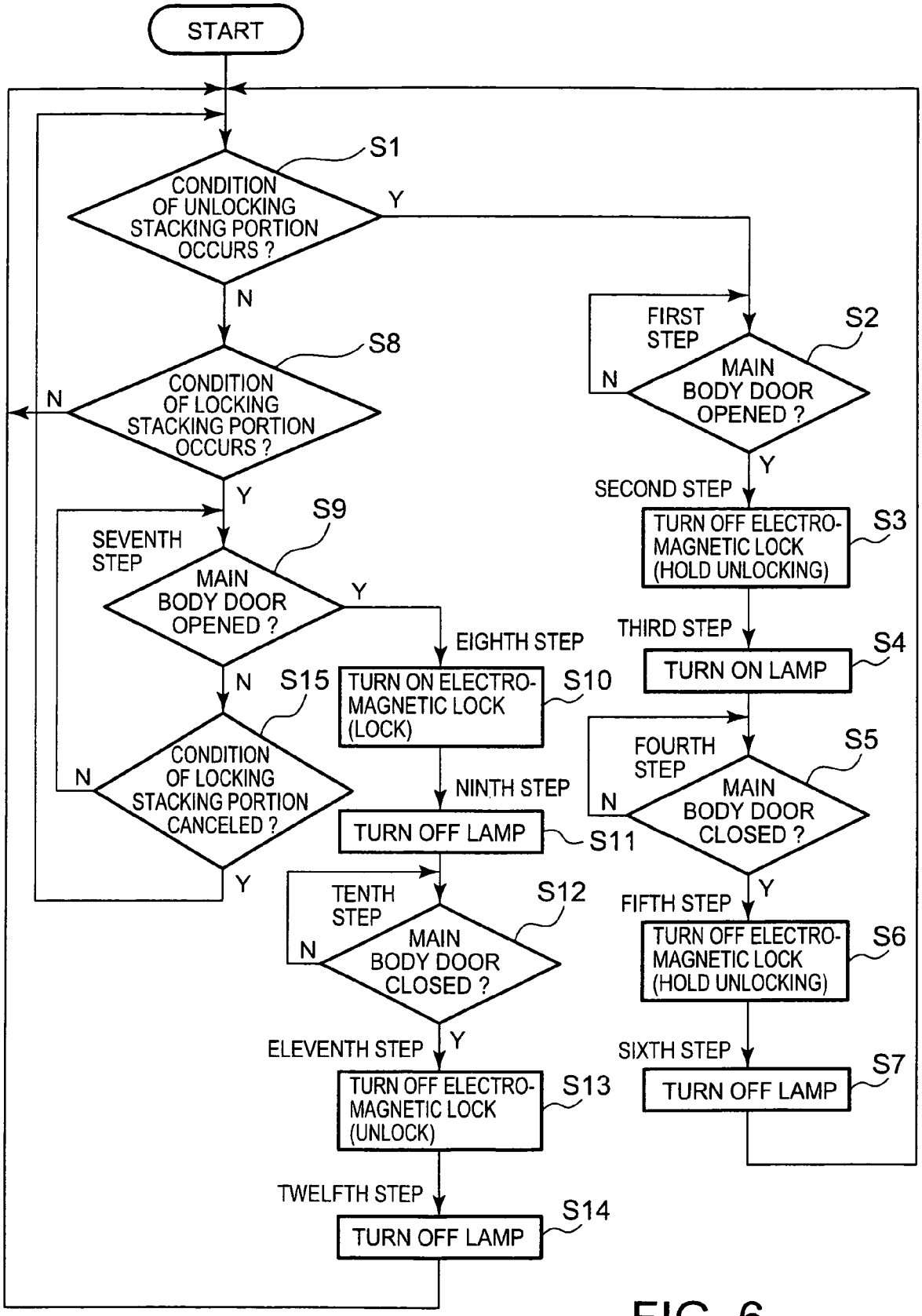
FIG. 6 is a flow chart for explaining the operation of the locking method of Embodiment 1 of the present invention.

FIG. 6 is a flow chart for explaining the operation of the locking method of the embodiment of the present invention. Hereinafter, it will be explained using the stacking device 71 explained in FIGS. 4 and 5.

For example, when any difficulty happens in the sheet processing apparatus (hereinafter, referred to as the main body) 100 and a condition for opening the stacking portion (for example, the stacking device 71) occurs (Y at Step S1), if any of the doors 103*a* to 105*a* of the main body 100 is opened (Y at S2), a condition for unlocking the stacking portion occurs (Y at Step S1) and when any of the doors 103*a* to 105*a* of the main body is opened (for example, the door 104*a* is opened), the opening of the door is detected by the door detection device 104*c* (Y at Step S2).

If the opening of the door is detected, to enable access (take-out, etc.) to the sheets P stacked on the stacking device 71, the electromagnetic lock is held in the unlocked state (Step S3). To notify that the stacking device 71 is in the unlocked state and can be accessed to the operator, the cover opening-closing permission display lamp 71*m* is turned on (Step S4).

The operator recognizes the lighting of the cover opening-closing permission display lamp 71*m*, opens the stacking storage cover 71*b* of the stacking device 71, and performs the difficulty removing operation such as removing the stacked sheets. After the operation is finished, the operator closes the stacking storage cover 71*b*, moves down the lever 71*e*, and then closes the door 104*a* of the main body.

If it is detected by the door detection device(the door opening-closing detection device) that the door 104*a* of the main body is closed (Y at Step S5), the electromagnetic lock of the stacking device 71 is turned off and the cover opening-closing permission display lamp is turned off (Step S7). As a result, the unlocking state is held in the state that no power is supplied to the solenoid.

When the condition of unlocking the stacking portion does not occur at Step S1 (N at Step S1), the door detection device confirms whether the condition of locking the stacking portion occurs or not (Step S8).

As a result of the confirmation, when a condition of locking the stacking portion occurs (Y at Step S8), the door detection device confirms whether the door of the main body is opened or not (Step S9). As a result of the confirmation, when the door of the main body is opened (Y at Step S9), the electromagnetic lock is turned on (Step S10) and the cover opening-closing permission display lamp 71*m* is turned off (Step S11).

The operator, when a predetermined process is finished, closes the door of the main body. If it is detected by the door detection device that the door 104*a* of the main body is closed (Y at Step S12), the electromagnetic lock of the stacking device 71 is turned off (Step S13) and the cover opening-closing permission display lamp is turned off (Step S14). As a result, the unlocking state is held when no power is supplied to the solenoid. After the process is finished, the process is returned to Step S1 and the sheet processing is continued.

At Step S9, the condition that the detected article 104*b* of the door 104*a* of the main body is detected by the door detection device 104*d* is the condition that the door is closed and this condition is hereinafter referred to as the case that the opening of the door is not detected (N at Step S9). In this case, the door detection device confirms whether the condition of locking the stacking portion is canceled or not (Step S15). As a result of this confirmation, when the condition of locking the stacking portion 71 is not canceled (N at Step S15), the process is returned to Step S9 and the opening of the door is monitored.

At Step S15, when the condition of locking the stacking portion is canceled (Y at Step S15), the process is returned to Step S1 and the sheet processing is continued.

As explained above, according to Embodiment 1 of the present invention, the power supply for the electromagnetic lock executed to ensure the security of the stacking storage cover 71*b* is limited to the case that the door of the main body 100 is opened, thus the power supply time of the electromagnetic lock can be shortened, so that the shortening of the life span of the solenoid and the power consumption can be reduced. As a result, the problem of "the power supply time under the electromagnetic lock is prolonged and the life span of the electromagnetic lock is shortened" described in the problem (1), the problem of "the power consumption of the apparatus is high" described in the problem (2), and the problem of "that the stacking device is under the electromagnetic lock is not known" described in the problem (3) can be solved.

Embodiment 2

Figure 7:
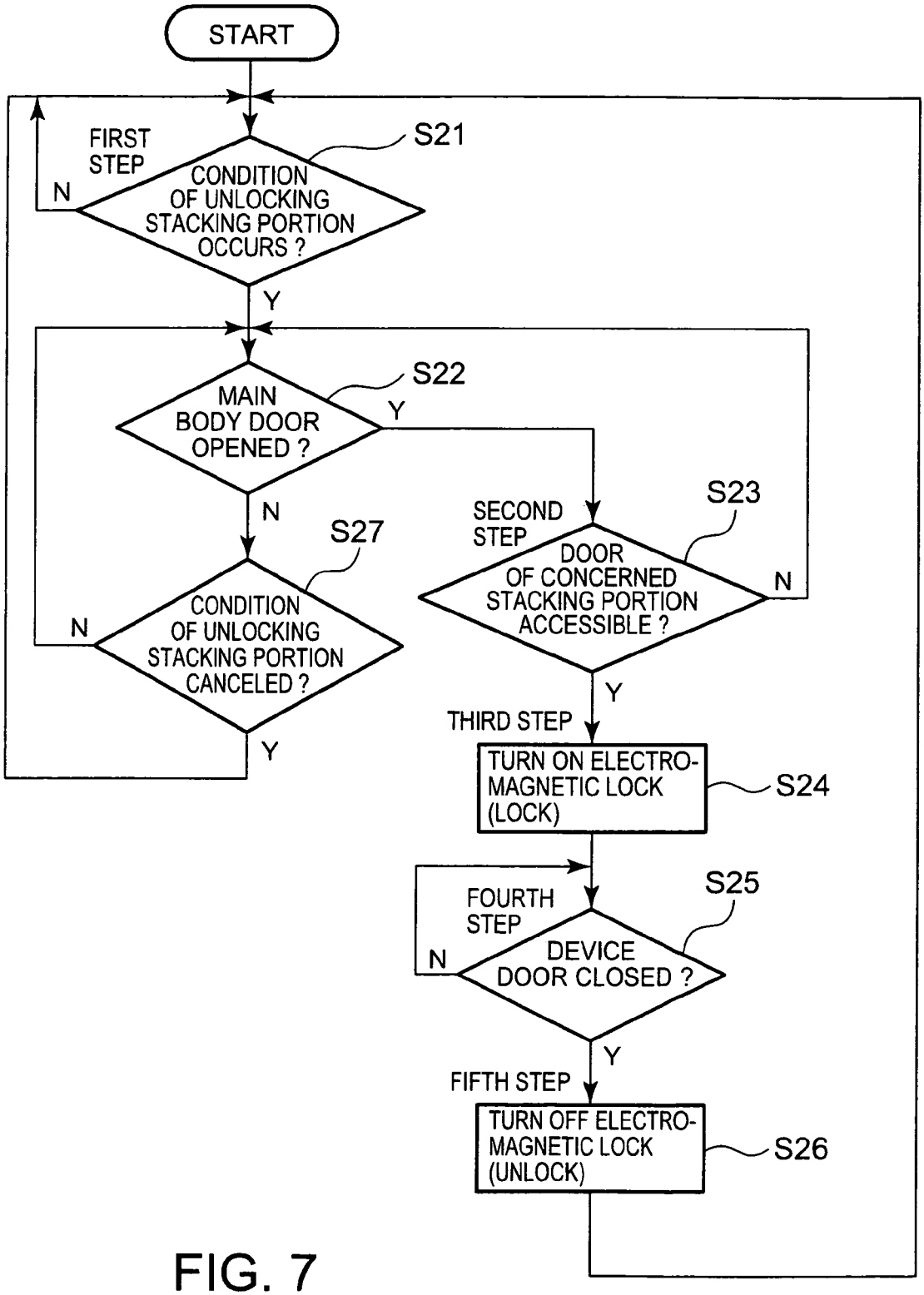
FIG. 7 is a flow chart for explaining the operation of the locking method of Embodiment 2 of the present invention.

FIG. 7 is a flow chart for explaining the operation of the locking method of Embodiment 2 of the present invention. Hereinafter, it will be explained by referring to FIGS. 2 to 5.

For example, when a difficulty happens in the third unit 104, and the door 104*a* or 104*b* is opened, and the operation of removing the difficulty is necessary, if it is necessary to remove the sheets stacked on the stacking devices 71 and 72 installed in the fourth unit 105 or lock the stacking devices 71 and 72 to prevent mixture with sheets due to the difficulty removal operation (Y at Step S21), whether any of the monitored doors 103*a* to 105*a* of the main body is detected by the door detection device arranged so as to detect the respective doors or not is confirmed (Step S22).

As a result of this confirmation, when the door of the main body is detected (Y at Step S22), whether the opened door is a door capable of accessing the stacking devices 71 and 72 or not is confirmed (Step S23).

As a result of this confirmation, when the opened door is the door capable of accessing the stacking devices 71 and 72 (in this embodiment, the doors 104*a* and 104*b* are applicable, Step S23), the electromagnetic lock is turned on (locked) (Step S24).

If the aforementioned difficulty removal operation is finished, and the doors 104*a* and 104*b* are closed, and the closed doors 104*a* and 104*b* are detected by the door detection device 104*d* (Y at Step S25), the internal security of the main body is ensured, so that the electromagnetic lock is turned off (Step S26).

Thereafter, the process is returned to Step S21 and the processing of the main body 100 is continued.

At Step S22, when the opening of the door of the main body 100 is not detected (N at Step S22), whether the condition of locking the stacking portion which occurs at Step S21 is canceled or not is confirmed (S27). As a result of this confirmation, if it is not canceled, the process is returned to Step S22 and the opening of the door of the main body 100 is monitored. Further, as a result of this confirmation, when the condition of locking the stacking portion is canceled, the process is returned to Step S21 and the processing of the main body 100 is continued.

As explained above, according to the embodiment of the present invention, when the door capable of accessing the concerned stacking portion is opened, the electromagnetic lock only of the concerned stacking portion is turned on (locked) and off (unlocked) and the electromagnetic locks of other unaccessible stacking devices can be kept off, so that compared with Embodiment 1, the power supply time for the solenoid is shortened more and a higher effect can be obtained.

At Step S22, when the door of the main body 100 is opened (Y at Step S22), the door detection device confirms whether it is the door capable of accessing the concerned stacking portion or not (Step S23). As a result of the confirmation at Step S23, when it is the door capable of accessing the concerned stacking portion (Y at Step S23), the door detection device turns on and locks the electromagnetic lock of the stacking portion (Step S24).

After the processing when the door of the main body 100 is opened is finished, the door detection device detects the closing of the door of the main body 100 (Step S25). As a result of this confirmation, when the door is closed (Y at Step S25), the door detection device turns off (unlocks) the electromagnetic lock (Step S26). The reason that the door is unlocked is that similarly to the description in Embodiment 1, since the door of the main body 100 is closed, the security of the staking portion is ensured, so that if the power supply to the solenoid is stopped, not only the solenoid can be prevented from high temperature but also unnecessary power supply is avoided, so that the power can be reduced. Thereafter, the process is returned to Step S21 and the processing of the sheets P is continued.

As explained above, according to Embodiment 2 of the present invention, when the door capable of accessing the concerned stacking portion is opened, the electromagnetic lock only of the concerned stacking portion is turned on (locked) and off (unlocked) and the electromagnetic locks of other unaccessible stacking devices can be kept off, so that the power supply time for the solenoid is shortened more and a higher effect can be obtained. As a result, for the problems (1) and (2), compared with Embodiment 1, a higher effect can be obtained.

Embodiment 3

Figure 8:
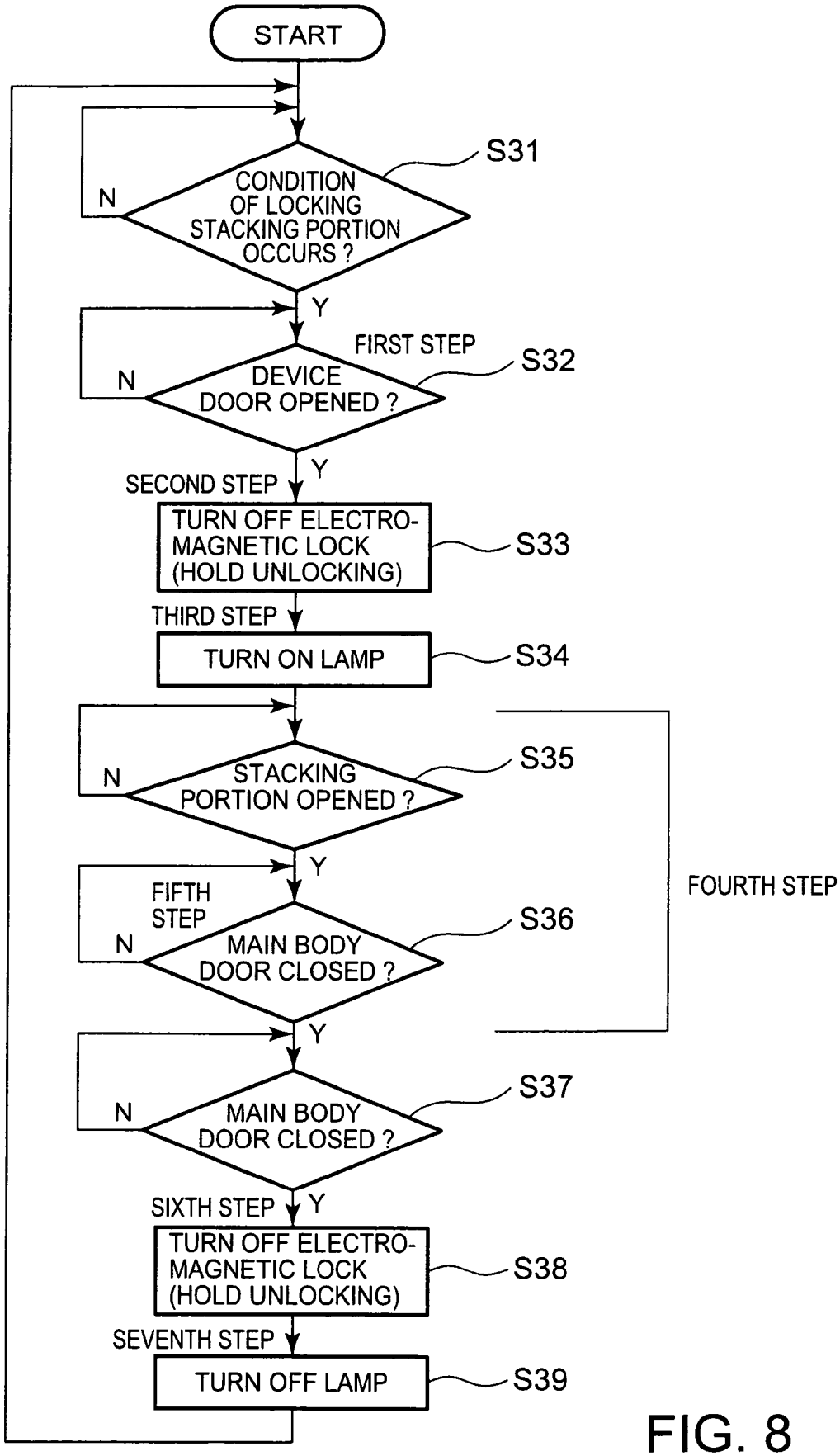
FIG. 8 is a flow chart for explaining the operation of the locking method of Embodiment 3 of the present invention.

FIG. 8 is a flow chart for explaining the operation of the locking method of Embodiment 3 of the present invention. Hereinafter, it will be explained by referring to FIGS. 2 to 5.

Among the same processes as those at Steps S2 to S7 indicating the processes when the condition of unlocking the stacking portion of Embodiment 1 shown in FIG. 6 occurs, the process of detecting the opening operation (Step S35) and the closing operation (Step S36) of the stacking portion cover of the stacking portion is added.

When the condition of unlocking the stacking portion occurs (Step S31), the door of the main body 100 is opened, and when the opening of the door is detected (Step S32), the unlocking state of the electromagnetic lock of the concerned stacking portion is held and the cover opening-closing permission display lamp 71*m* is turned on (Step S34).

The operator confirming the cover opening-closing permission display lamp opens the stacking storage cover 71*b* of the stacking portion 71 (Step S35), takes out the stacked sheets, and closes the stacking storage cover (Step S36). When the stacking storage cover 71*b* is opened and closed, the lever sensor 71*c* detects that the light shield plate 71*d* is on (there is the light shield plate) and off (there is no light shield plate). On the basis of the detection results, it is detected that the stacking storage cover 71*b* is opened and closed (Step S37). If it is detected that the stacking storage cover 71*b* is opened and closed, the unlocking of the electromagnetic lock is held (Step S38). Then, the cover opening-closing permission display lamp 71*m* is turned off (Step S39).

As explained above, according to Embodiment 3 of the present invention, in addition to the effect of Embodiment 1, "Although the operator should perform the process of the stacking portion, if he does not perform it but performs the initialization, the program goes to the next process, thus the sheet processing apparatus may not be operated normally, and a difficulty may be caused" described in the problem (3) can be solved.

Embodiment 4

Figure 9:
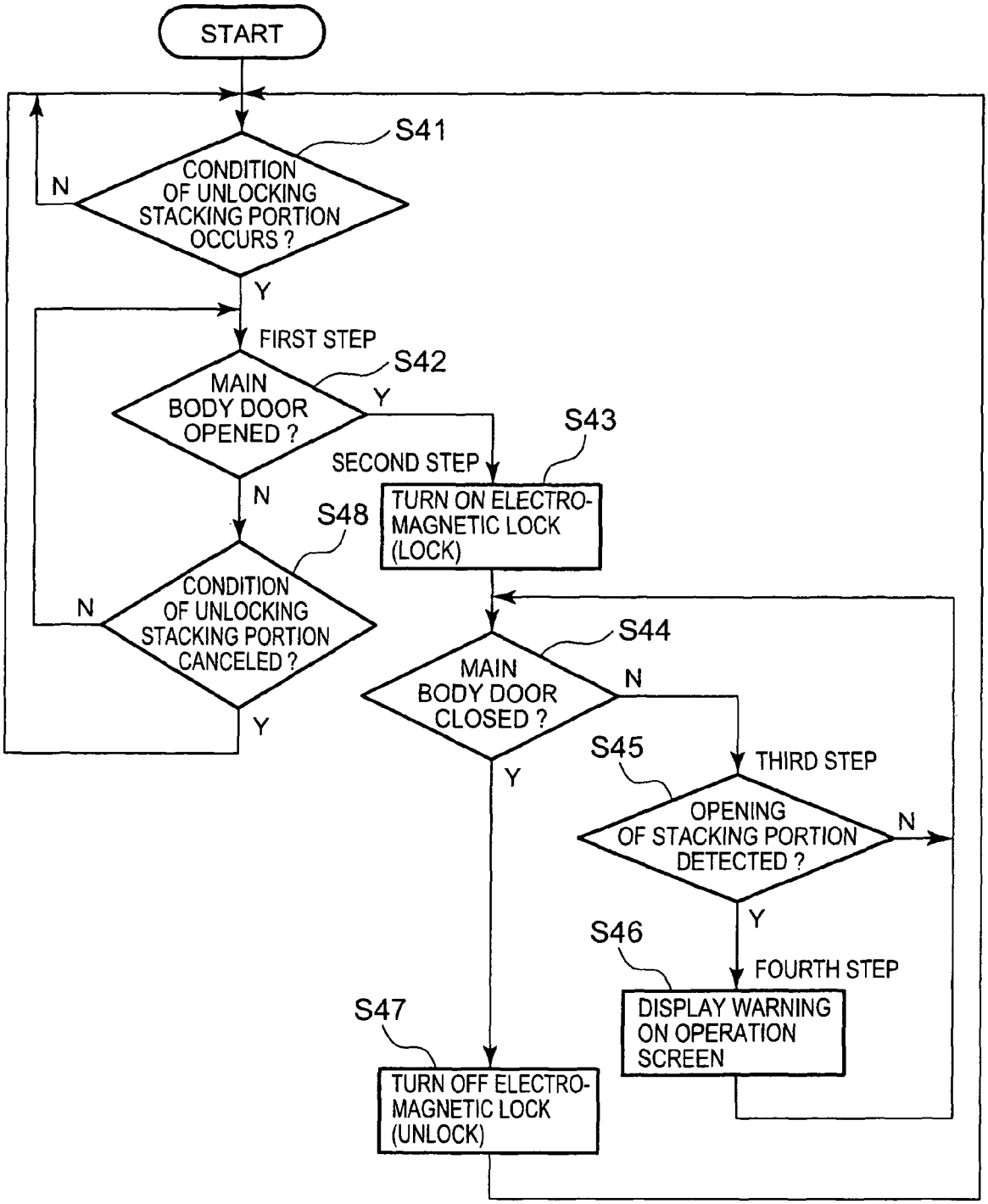
FIG. 9 is a flow chart for explaining the operation of the locking method of Embodiment 4 of the present invention.

FIG. 9 is a flow chart for explaining the operation of the locking method of Embodiment 4 of the present invention. Hereinafter, it will be explained by referring to FIGS. 2 to 5 and 7.

The present invention, when the condition of locking the stacking portion occurs, if the stacking portion is opened and closed by the operator, is an embodiment when displaying a malfunction on an operation display device 33.

The processes at Steps S21, S22, and S27 indicated in Embodiment 2 when the condition of locking the stacking portion occurs are the same as those at the steps S41, S42, and S48 of this embodiment. However, since the process after the opening of the door of the main body 100 is detected at Step S42 is different, the process of that portion will be explained below.

When the opening of any of the doors 103*a* to 105*a* of the main body 100 is detected (Step S42), the electromagnetic lock is turned on and the stacking portion is locked (Step S43). Next, the closing of the door of the main body 100 is detected (Step S44).

As a result of the detection, when the door is not closed (No at Step S44), the light shield plate 71 is detected by the lever position sensor 71*c* of the stacking portion and whether the stacking storage cover 71*b* of the staking portion is opened or not is detected (Step S45).

As a result of the detection, when it is not detected (No at Step S25), the process is returned to Step S24 and whether the door of the main body 100 or the stacking storage cover 71*b* of the stacking portion is opened and closed or not is monitored.

As a result of the monitoring, when it is detected that the stacking storage cover 71*b* of the stacking portion is opened, a warning is displayed on the operation display device 33. Namely, since the condition of locking the stacking portion occurs, the opening of the door should not be detected originally by the stacking portion, though when the operator opens it by mistake, the opening of the door is detected. In that case, a warning accompanying the malfunction is displayed on the operation display device 33.

The malfunction is monitored until the opening of the door by the main body 100 is detected (Steps S44 to S46).

As a result of the detection, when the closing of the door of the main body 100 is detected (Y at Step S44), the electromagnetic lock is turned off (Step S47). Thereafter, the process is returned to Step S41 and the ordinary process is continued.

As explained above, according to Embodiment 4 of the present invention, when the condition of locking the stacking portion occurs, the door of the main body 100 enters the open state and furthermore when the stacking storage cover 71*b* of the stacking portion enters the closed state, there are possibilities that an error operation may be performed by the operator, so that in this case, a warning is displayed on the operation display device 33 and care can be requested for the operator. As a result, the convenience of a manager (operator) for managing the main body 100 is improved.

Embodiment 5

Figure 10:
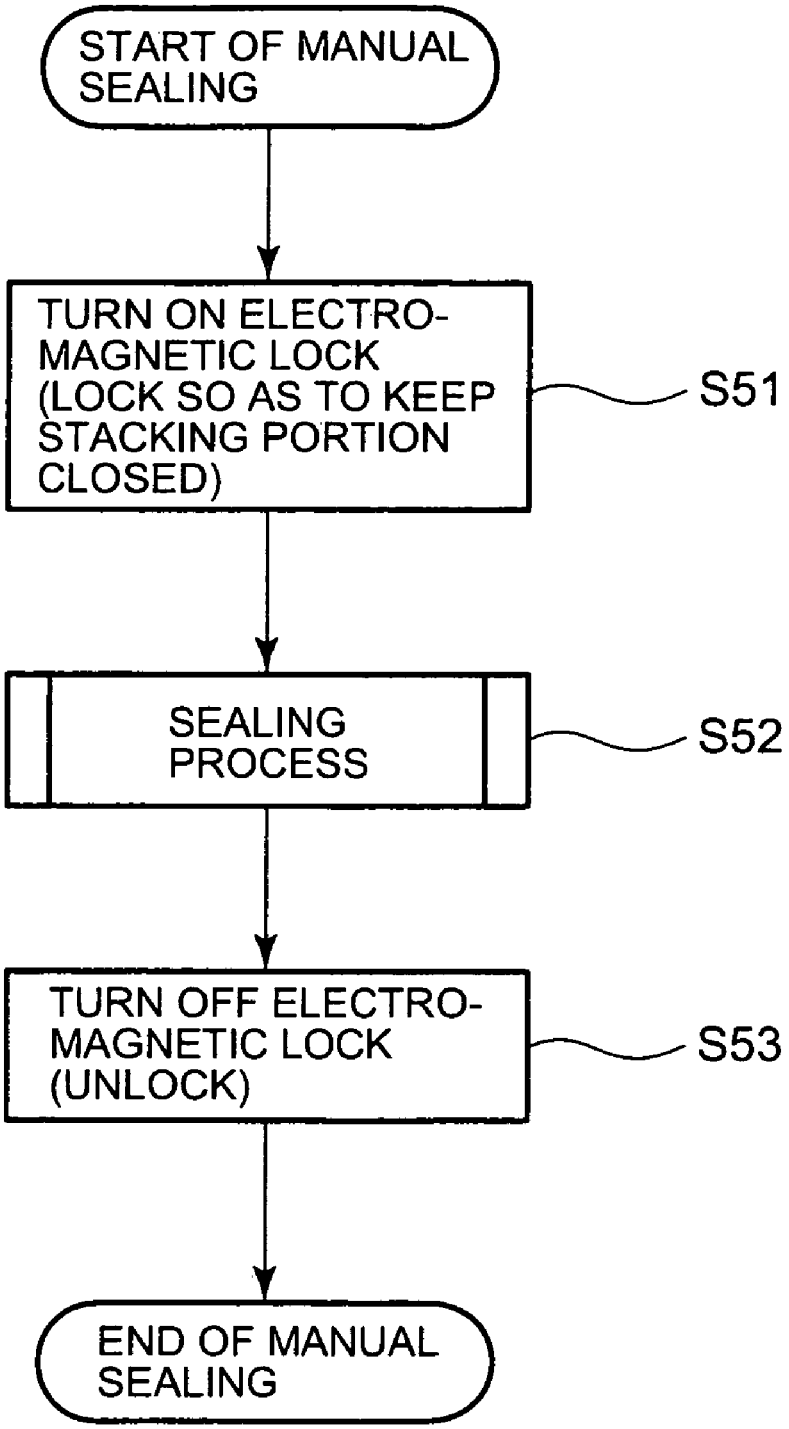
FIG. 10 is a flow chart for explaining the operation of the locking method of Embodiment 5 of the present invention.

FIG. 10 is a flow chart for explaining the operation relating to manual sealing activation. It is an operation flow relating to the locking method of the stacking device when manually sealing 100 sheets by the operator. Hereinafter, it will be explained by referring to FIGS. 2 to 5. Here, the case that 100 sheets are sealed manually using the stacking device 71 is explained, though the same may be said with the other stacking devices.

When the operator presses the manual binding start switch 71*h*, the stacking cover 71*b* of the stacking device 71 is locked electromagnetically (Step S51).

Next, the sheets P stacked on the stacking device 71 are transferred to the sealing device 81 and are bound (sealed) by a paper strap (Step S52). The sealing process is displayed in the sub-routine, though it can be performed by the conventional art and it is not the object of the present invention, so that the explanation thereof will be omitted.

Next, when the sealing process is finished, the electromagnetic lock of the stacking cover 71*b* of the stacking device 71 is canceled and the process is finished (Step S53).

As explained above, according to Embodiment 5 of the present invention, the stacking cover 71*b* is prevented from opening by mistake during the binding operation, so that the injury such as device stop accompanying the malfunction described in the problem (4) can be prevented.

According to the present invention, the door condition of the sheet processing apparatus is detected, thus the power supply time of the electromagnetic lock can be shortened, so that the life span of the electromagnetic lock is lengthened, and the power consumption of the sheet processing apparatus is suppressed, and it is found that the stacking device is under the electromagnetic lock, so that the malfunction can be prevented.

What is claimed is:

1. A sheet processing apparatus including a plurality of units each having a processing unit to sort, process, and store sheets in a main body, the sheet processing apparatus comprising:

a door, disposed in at least one of the units, configured to be opened and closed when accessing the processing unit arranged in the unit; and a door opening-closing detection device configured to detect the opening and closing of the door;

an operation display device having an input device to enable input by an operator and a display device to notify the operator;

a conveying path to convey the sheets;

a sheet check device to discriminate the sheets conveyed by the conveying path;

a stacking device, disposed in at least one of the processing units, having a stacking storage to stack the sheets based on the discrimination results of the sheet check device and a stacking storage cover to protect the stacked sheets;

a sealing device to seal the stacked sheets stacked in the stacking device;

an electromagnetic locking device to lock and unlock the stacking storage cover;

a cover opening-closing permission display to indicate permission to open the stacking storage cover; and a controller to control the electromagnetic locking device to lock or unlock the stacking storage cover based on the detection results of the door opening-closing detection device, wherein, upon a condition occurs for gaining access to and servicing the stacking device:

the electromagnetic locking device is turned off to unlock the stacking storage cover, the opening-closing detection device detects when the door of the corresponding unit door has been opened, in response to detecting that the unit door is open, maintain the electromagnetic device in the unlocked state to enable access to the stacking device, the opening-closing detection device detects whether the unit door of the detecting that the unit door has remained open, when the stacking storage cover is closed, and in response to detecting that the unit door is open while the stacking storage cover is closed, the electromagnetic locking device is turned on to lock the stacking storage cover and disable access to the stacking device.

2. The sheet processing apparatus according to claim 1, wherein:

each of the processing units further include a manual binding start switch to manually start the sealing device; and in response to the manual binding start switch being pressed, electromagnetic locking device locks the stacking storage cover of the stacking storage, seals the sheets stacked on the stacking storage by the sealing device, and then unlocks the stacking storage cover.

3. An electromagnetic locking method of a stacking device in a sheet processing apparatus that includes a plurality of units each having a processing unit to sort, process, and store sheets in a main body, at least one of the units including a door to be opened and closed when accessing the processing units arranged in the units and a door opening-closing detection device to detect opening and closing of the door, at least one of the processing units including an operation display having an input device to input by an operator and a display to notify the operator, a conveying path to convey the sheets, a sheet check device to discriminate the sheets conveyed by the conveying path, a stacking device having a stacking storage to stack the sheets based on the discrimination results of the sheet check device and a stacking storage cover to protect the stacked sheets, a sealing device to seal the sheets stacked on the stacking device, an electromagnetic locking device to lock and unlock the stacking storage cover, a cover opening-closing permission display to display permission of opening and closing of the stacking store cover, and a controller, when a condition of locking or unlocking the stacking device occurs, to control the electromagnetic locking device to lock or unlock the stacking storage cover based on the detection results of the door opening-closing detection device, wherein, upon a condition occurring for gaining access to and servicing the stacking device, the electromagnetic locking method comprises:

turning off the electromagnetic lock to unlock the stacking storage cover;

detecting opening of the door of the corresponding unit by the door opening-closing detection device;

in response to detecting that the unit door is open, maintaining the electromagnetic device in the unlocked state, to enable access to the stacking device;

displaying the cover opening-closing permission display;

detecting closing of the unit door by the door opening-closing detection device after the stacking device has been serviced based on the cover opening-closing permission display results;

in response to detecting that the unit door has been closed, turning off the electromagnetic lock; and turning off the opening-closing permission display.

4. The electromagnetic locking method of a stacking device according to claim 3 further comprising:

when a condition of locking the stacking storage cover occurs during the processing of the sheets with the corresponding unit door closed, turning off the electromagnetic lock, unlocking the stacking storage cover, and detecting whether the unit door has been opened by the door opening-closing detection device;

upon detecting that the unit door is open turning on the electromagnetic lock to lock the stacking storage cover;

displaying the cover opening-closing permission display;

after the stacking device has been serviced based on the displayed results, detecting closing of the unit door by the door opening-closing detection device;

upon detecting that the unit door is closed turning off the electromagnetic lock; and turning off the cover opening-closing permission display.

5. An electromagnetic locking method of a stacking device in a sheet processing apparatus that includes a plurality of units each having a processing unit to sort, process, and store sheets in a main body, at least one of the units including a door to be opened and closed when accessing the processing units arranged in the units and a door opening-closing detection device to detect opening and closing of the door, at least one of the processing units including an operation display having an input device to input by an operator and a display to notify the operator, a conveying path to convey the sheets, a sheet check device to discriminate the sheets conveyed by the conveying path, a stacking device having a stacking storage to stack the sheets based on the discrimination results of the sheet check device and a stacking storage cover to protect the stacked sheets, a sealing device to seal the sheets stacked on the stacking device, an electromagnetic locking device to lock and unlock the stacking storage cover, a cover opening-closing permission display to display permission of opening and closing of the stacking store cover, and a controller, when a condition of locking or unlocking the stacking device occurs, to control the electromagnetic locking device to lock or unlock the stacking storage cover based on the detection results of the door opening-closing detection device, wherein, upon a condition occurring for gaining access to and servicing the stacking device, the electromagnetic locking method comprises:

turning off the electromagnetic lock to unlock the stacking storage cover;

detecting opening of a door by the door opening-closing detection device;

in response to detecting that a door is open, confirming whether the open door corresponds to a door that provides access to the stacking device is detected or not;

when the opening of the door accessible to the stacking device is detected, turning on the electromagnetic lock to lock the stacking storage cover;

after the stacking device has been serviced, detecting closing of the corresponding door by the door opening-closing detection device; and when the closing of the corresponding door is detected turning off the electromagnetic lock.

6. An electromagnetic locking method of a stacking device in a sheet processing apparatus that includes a plurality of units each having a processing unit to sort, process, and store sheets in a main body, at least one of the units including a door to be opened and closed when accessing the processing units arranged in the units and a door opening-closing detection device to detect opening and closing of the door, at least one of the processing units including an operation display having an input device to input by an operator and a display to notify the operator, a conveying path to convey the sheets, a sheet check device to discriminate the sheets conveyed by the conveying path, a stacking device having a stacking storage to stack the sheets based on the discrimination results of the sheet check device and a stacking storage cover to protect the stacked sheets, a sealing device to seal the sheets stacked on the stacking device, an electromagnetic locking device to lock and unlock the stacking storage cover, a cover opening-closing permission display to display permission of opening and closing of the stacking store cover, and a controller, when a condition of locking or unlocking the stacking device occurs, to control the electromagnetic locking device to lock or unlock the stacking storage cover based on the detection results of the door opening-closing detection device, wherein, upon a condition occurring for gaining access to and servicing the stacking device, the electromagnetic locking method comprises:

turning off the electromagnetic lock to unlock the stacking storage cover and detecting opening of the door of the corresponding unit by the door opening-closing detection device;

maintaining the electromagnetic device in the unlocked state, to enable access to the stacking device, while the opening-closing detection device detects that the corresponding unit door is open;

displaying the cover opening-closing permission display;

detecting whether the stacking storage cover is opened and then closed based on the cover opening-closing permission display results;

in response to detecting the opening and closing of the stacking storage cover, detecting closing of the corresponding unit door;

turning off the electromagnetic lock after detecting that the unit door is closed; and turning off the cover opening-closing permission display.

7. An electromagnetic locking method of a stacking device in a sheet processing apparatus that includes a plurality of units each having a processing unit to sort, process, and store sheets in a main body, at least one of the units including a door to be opened and closed when accessing the processing units arranged in the units and a door opening-closing detection device to detect opening and closing of the door, at least one of the processing units including an operation display having an input device to input by an operator and a display to notify the operator, a conveying path to convey the sheets, a sheet check device to discriminate the sheets conveyed by the conveying path, a stacking device having a stacking storage to stack the sheets based on the discrimination results of the sheet check device and a stacking storage cover to protect the stacked sheets, a sealing device to seal the sheets stacked on the stacking device, an electromagnetic locking device to lock and unlock the stacking storage cover, a cover opening-closing permission display to display permission of opening and closing of the stacking store cover, and a controller, when a condition of locking or unlocking the stacking device occurs, to control the electromagnetic locking device to lock or unlock the stacking storage cover based on the detection results of the door opening-closing detection device, wherein, upon a condition occurring for gaining access to and servicing the stacking device, the electromagnetic locking method comprises:

turning off the electromagnetic lock to unlock the stacking storage cover and detecting opening of the door of the corresponding unit by the door opening-closing detection device;

when the opening of the door is detected turning on the electromagnetic lock to lock the stacking storage cover;

after the electromagnetic lock locks the stacking storage cover, if the opening of the stacking storage cover is detected before the closing of the unit door is detected, detecting the opening and closing of the stacking storage cover; and displaying a warning message of a malfunction on the operation display device.

* * * * *